United States Patent [19]

Cook

[11] 4,413,587

[45] Nov. 8, 1983

[54] CAN OR TUBE ADHESIVE APPLICATOR

[75] Inventor: Ronald Cook, Marquand, Mo.

[73] Assignee: Tools & Machinery Builders, Inc., Arcadia, Mo.

[21] Appl. No.: 302,067

[22] Filed: Sep. 14, 1981

[51] Int. Cl.[3] ..... B05C 1/02; B05C 7/06

[52] U.S. Cl. ..... 118/210; 118/211; 118/214; 118/232; 118/239; 118/244

[58] Field of Search ..... 118/210, 211, 232, 239, 118/244, 214

[56] References Cited

U.S. PATENT DOCUMENTS

| | | | |
|---|---|---|---|
| 1,094,139 | 4/1914 | Forte | 118/239 X |
| 2,124,722 | 7/1938 | Walter | 118/232 |
| 2,388,911 | 11/1945 | Fink | 118/232 |
| 2,531,914 | 11/1950 | Lager et al. | 118/232 X |
| 3,695,223 | 10/1972 | Dunham et al. | 118/239 X |

*Primary Examiner*—John P. McIntosh

*Attorney, Agent, or Firm*—Summers, Compton, Wells & Hamburg

[57] ABSTRACT

An apparatus to apply uniform amounts of adhesive to containers at a high rate of speed. Containers are selected at a variable interval. The containers are positioned against dual spiral timing screws (one timing screw above the other). Turning the timing screws a constant (but adjustable) number of degrees with respect to each other while they rotate at the same speed will either advance a container in a level position or they may be advanced while tilted, forward or backward depending upon the relative position of the upper and lower timing screw. While the container is advancing, it is also being turned so that the upper surfaces of the container may be positioned against a rotating cylinder to which a layer of adhesive is continuously applied. In this manner adhesive may be applied around the entire circumference of a container on the top, inside edge, outside edge or both edges.

6 Claims, 10 Drawing Figures

CAN OR TUBE ADHESIVE APPLICATOR

BACKGROUND OF THE INVENTION

The invention relates to the application of adhesive substances to tubes or containers. Containers such as cans or tubes are formed, filled and closed during a plurality of operations. Because of the large volume of cans or tubes necessary to be produced for utilization in the marketing of goods, it is most desirable that the container be formed in an assembly line fashion at the highest rate of speed possible. One step in the formation of containers is the application of an adhesive substance that either alone, or in combination with friction fit or some other method, will seal the ends of the containers. Because of the varying types and sizes of containers and the high capital investment for the equipment, it is also desirable that any sealant application apparatus be widely adjustable as to height and diameter of the container, speed of production and other variables. It has been a problem in the composite can industry to produce a production line adhesive applicator which would apply adhesive at a reliable high rate of production to any of the top outside edge, inside edge or flanged edge of a container or tube. High production rates often produce uneven or inadequate adhesive application to the can or container. To compensate for this problem, higher quantities of adhesive application have been used in the past, or the rate of production is lowered, or both, which adds substantially to the cost of the container.

SUMMARY OF THE INVENTION

It is the overall object of the invention to provide a flexible approach to apply adhesive to various sizes and diameters of tubes or containers at a high rate of speed, accepting them from and discharging them to a conveyor belt line. The containers are automatically selected at a proper and variable interval, inclined at the appropriate angle to accept adhesive, and then rotated while being moved along the production line at a controlled rate of speed and rotation to evenly expose the entire surface upon which adhesive is to be applied to an adhesive applicator.

DESCRIPTION OF THE PREFERRED EMBODIMENT

Figure 6:
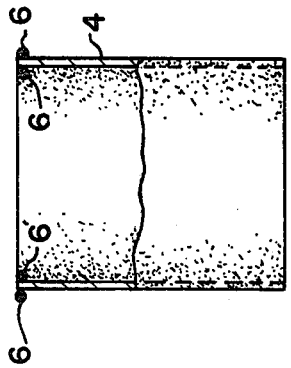
FIG. 6 shows adhesive on the upper surface both inside and outside of the wall of can (4).
Figure 5:
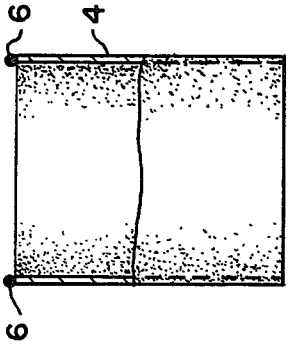
FIG. 5 shows adhesive on the top of can (4).
Figure 4:
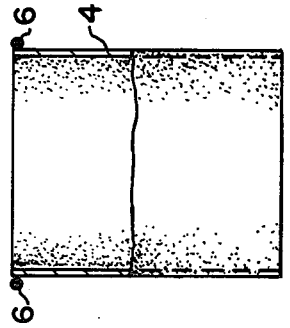
FIG. 4 shows adhesive on the upper outside surface of the wall of can (4).
Figure 3:
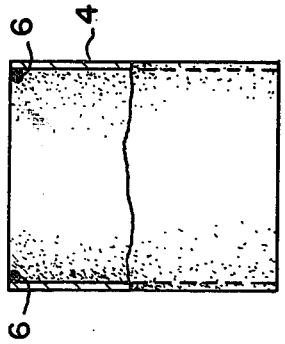
FIG. 3 shows adhesive on the upper inside surface of the wall of can (4).

The preferred embodiment shown comprises an adhesive applicator roll (1) upon which is applied adhesive (6), the rate of which is controlled by the applicator roll adhesive thickness plate (5). The film thickness of the adhesive (6) and the rate of application of the adhesive is controlled by the separation of the applicator roll adhesive thickness plate (5) from the adhesive applicator roll (1). Liquid adhesive or sealant (6) is contained in the reservoir above applicator roll adhesive thickness plate (5). The adhesive applicator roll (1) is rotated at adjustable speeds to control the rate of adhesive application. The adhesive applicator roll (1) is pivoted by pivot arm (10) operated by lift means (3) which is engaged to produce a variable height of adhesive applicator roll (1) for various can heights and to remove adhesive applicator roll (1) from can (4) if the production line stops, to prevent over-application of adhesive.

Figure 2:
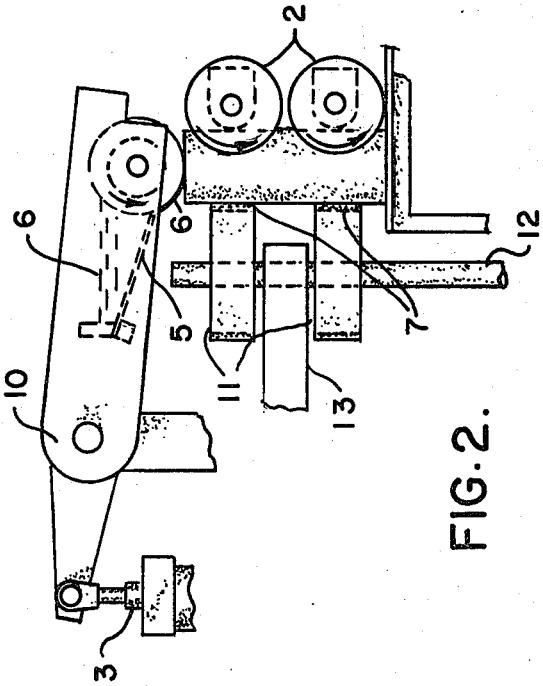
FIG. 2 is an end view of the apparatus.
Figure 7:
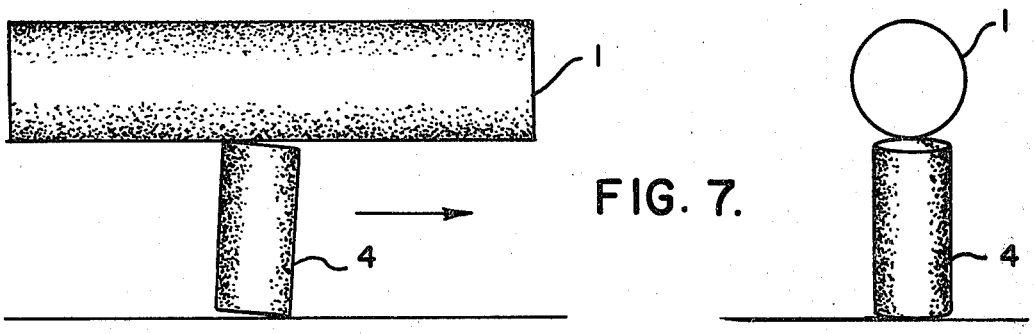
FIG. 7 shows the positioning of can (4) and the apparatus to produce the adhesive bead shown in FIG. 3.
Figure 8:
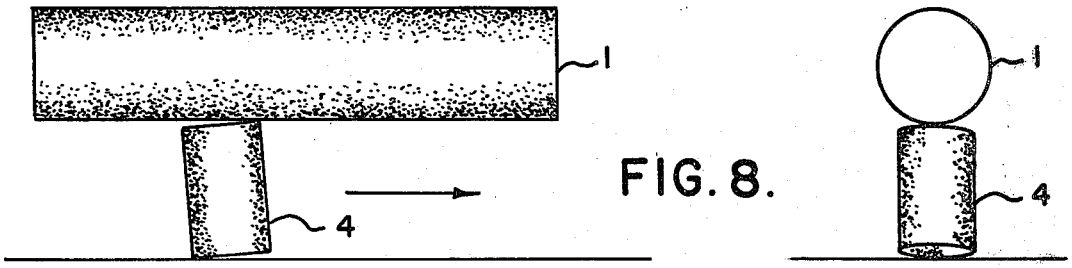
FIG. 8 shows the positioning of can (4) and the apparatus to produce the adhesive bead shown in FIG. 4.
Figure 9:
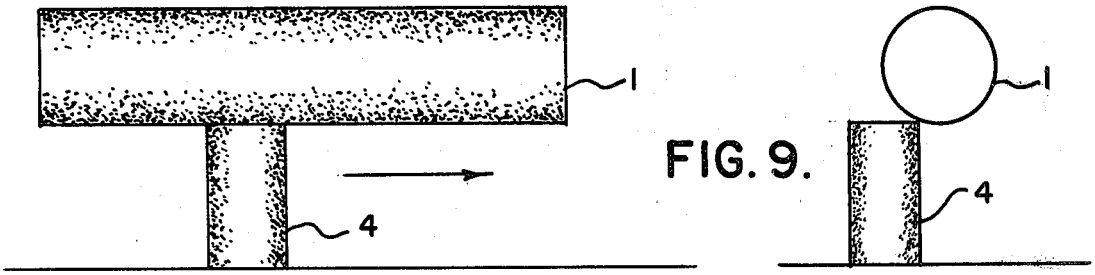
FIG. 9 shows the positioning of can (4) and the apparatus to produce the adhesive bead shown in FIG. 5.
Figure 10:
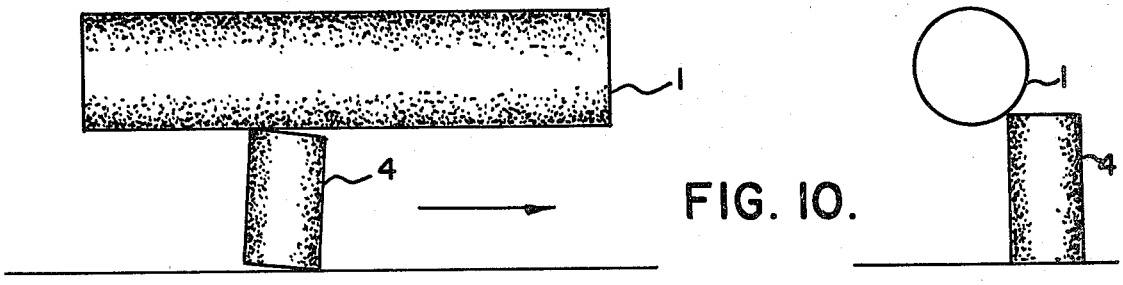
FIG. 10 shows the positioning of can (4) and the apparatus to produce the adhesive bead shown in FIG. 6.

In operation, a can (4) is delivered to the apparatus as shown in FIG. #1 through conveyor means approaching the apparatus from the left. The can rests on a slide plate (9) which, preferably, is polished metal, but may also be a table top, conveyor top, and/or machine top. Can (4) is engaged by dual timing screws (2). Timing screws (2) are made of Teflon or equivalent material, with a low coefficient of friction to prevent binding of can (4). Timing screws (2) are adjustable in separation to provide for various can sizes. Timing screws (2) are offset from one another to grip and guide can (4), and are arranged to rotate so that their speeds may be controlled at a defined (but variable) rate. The rate of rotation of timing screws (2) can be varied to control the rate of production as well as maintaining a constant differential in position of relative rotation between the upper and lower timing screws (2). As viewed from FIG. 2, turning the upper timing screw (2) a constant number of degrees counter clockwise relative to the lower timing screw (2), will cause the can (4) to be tilted forward, thus exposing the inside top edge of can (4) to adhesive applicator roll (1). Conversly, a clockwise differential of relative rotation of the upper timing screw (2) relative to the lower timing screw, when viewed in FIG. 2, will tilt can (4) backward, exposing the front of can (4) to the adhesive applicator roll (1). The position of forward tilt will apply a bead of adhesive to the inside upper lip of can (4) if can (4) is moved transversly with its center line identical to the center line of the adhesive applicator roll (1) (see FIGS. (3) and (7)). Adhesive may be applied in various other locations on the can rim by tilting can (4) backwards, which produces a layer of adhesive on the outside of the top of the can wall container (see FIGS. (4) and (8)); or, offsetting the container to the side of the center line of applicator roll (1) will produce a bead of adhesive on the top of the can (see FIGS. (5) and (9)); or, tilted forward and offset, can (4) will produce two contact points with adhesive applicator roll (1), one pushing and one scraping, leaving a bead of adhesive on both the inside and the outside of the top of the container (see FIGS. (6) and (10)). The same results can be produced with a can having a flanged wall. The counter clockwise rotation of timing screws (2) helps to grip and stabilize can (4) on plate (9).

Figure 1:
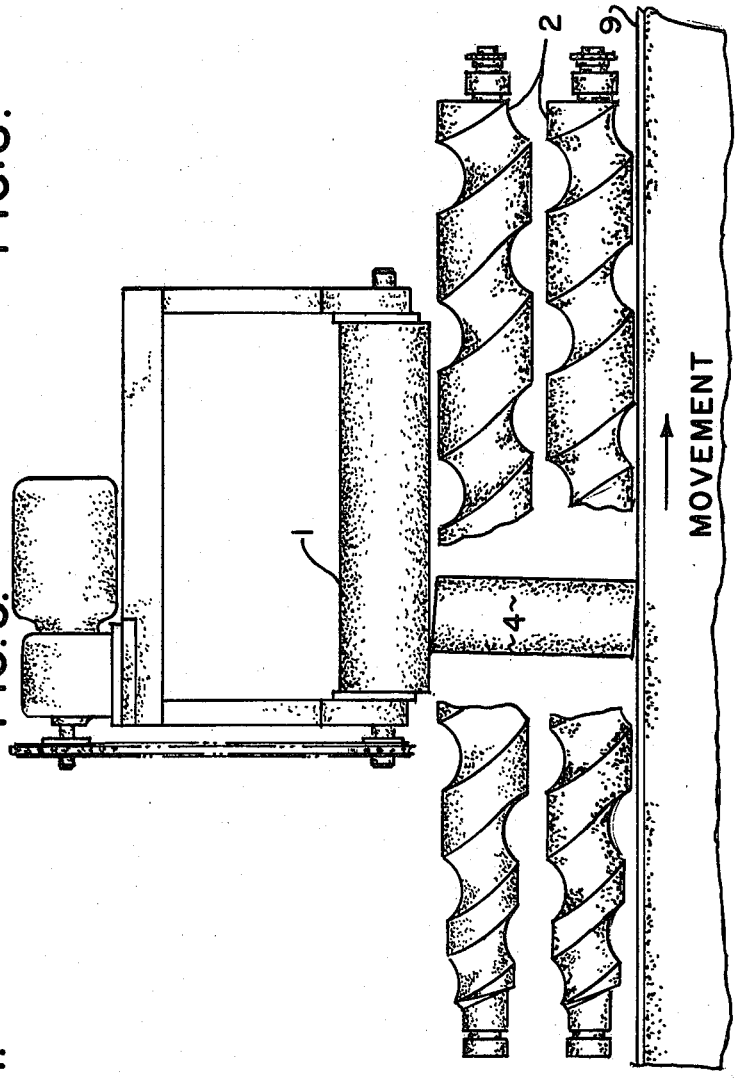
FIG. 1 is an elevational view of the apparatus.

As can (4) is moved transversely along FIG. 1 from the left to the right, it is pressed against timing screws (FIG. 2) by contact belts (7). Belts (7) are located on pulleys (11), which are rotated at equal adjustable speeds by common drive shaft (12). This rotation is adjustable and controls the rate of rotation of can (4). Drive shaft (12) is mounted within bracket (13), which bracket is moveable, horizontally, to adjust for the size of can (4) and to regulate the amount of pressure which is applied by belt (7) to hold can (4) against the timing screws (2). As timing screws (2) are rotated, can (4) will advance across plate (9), contacting applicator roll (1). At the same time that can (4) is advancing laterally, due to the action of the timing screws (2), it is also rotating as a result of belts (7). The speed of rotation of can (4) is controlled by belts (7). The number of times that a bead of adhesive is applied to the top of can (4) by adhesive applicator roll (1) is controlled by the circumference of can (4), the speed of belts (7), and timing screws (2). Timing screws (2) may deliver containers or tubes at any given space increment (if replaced with timing screws with a different pitch) directly into an integrated machine starwheel timing screw and/or turret onto a conveyor belt for insertion of caps. As an example of the differential in speed which can be expected between this apparatus and a conventional design, plastic tubular filled containers were previously able to have the adhesive applied at about one hundred ten (110) cans per minute. This apparatus, in experimental form, will apply adhesive to three hundred (300) filled plastic cans per minute.

I claim:

1. An apparatus for applying substantially uniform amounts of adhesive or sealant material to container members, said apparatus comprising:

(i) container means;

(ii) means communicating with said container means to apply a controlled quantity of adhesive from said container means to an adhesive applicator;

(iii) means to position and rotate said adhesive applicator;

(iv) two (2) spiral timing screws, one mounted above the other in a generally parallel orientation and each having a spiral groove sufficient to grip a container member;

(v) said spiral timing screws being adjustably positioned to both accept container members at regular intervals and to move said containers past and the top of said container members in contact with said adhesive applicator in order to apply one or more beads of adhesive to said container member;

(vi) means connected to said timing screws to control the rate of rotation thereof, means to adjust to a desired differential the number of degrees of relative rotation of one timing screw to the other for a given rate of rotation, so that said container member being advanced into the grooves of said timing screws may be tilted through a range of angles by said timing screws;

(vii) positioning means to position the center line of said container member relative to the center line of the adhesive applicator as said container member is advanced past said adhesive applicator; and (viii) means spaced from said timing screws and below the adhesive applicator to receive the container member therebetween and to rotate said container member while said container member is being advanced by said timing screws past the adhesive applicator.

2. The apparatus of claim 1 wherein the means to control the rotation of said timing screws rotates said timing screws toward a base of the apparatus to firmly position the container member against the base.

3. The apparatus of claim 1, wherein the adhesive applicator is a cylinder.

4. The apparatus of claim 1, wherein the means to rotate and postion the adhesive applicator is a pivot arm operated by lift means which controls the height of the applicator to accomodate containers of various heights.

5. The apparatus of claim 1, wherein the means to apply adhesive to the adhesive applicator comprises a plate having a beveled edge at the point of contact with said adhesive applicator forming a lower member of said adhesive reservoir and extending the length of said adhesive applicator adjustable for the wiping action and clearance between said plates and said adhesive applicator.

6. The apparatus of claim 1, wherein the means to rotate said container member comprises two pulley operated belts parallel to said timing screws and operating cooperatively therewith to simultaneously advance and rotate said container member.

* * * * *